United States Patent [19]

Palecek et al.

[11] Patent Number: 5,042,377

[45] Date of Patent: Aug. 27, 1991

[54] AUTOMATIC DAMPENING SYSTEM FOR LITHOGRAPHIC PRINTING PRESS

[76] Inventors: Frank H. Palecek, 335 N. Briery Rd., Irving, Tex. 75061; William A. Sullivan, 3821 Grand Teton, Irving, Tex. 75062

[21] Appl. No.: 409,423

[22] Filed: Sep. 19, 1989

[51] Int. Cl.[5] ..... B41F 7/26; B41F 7/36; B41F 7/40

[52] U.S. Cl. ..... 101/148

[58] Field of Search ..... 101/148, 147, 349, 350, 101/351, 352, 363, 207-210

[56] References Cited

U.S. PATENT DOCUMENTS

| | | | |
|---|---|---|---|
| 3,673,959 | 7/1972 | Jezuit et al. | 101/148 |
| 4,233,898 | 11/1980 | Dahlgren | 101/148 X |
| 4,373,442 | 2/1983 | Dahlgren et al. | 101/207 |

*Primary Examiner*—J. Reed Fisher
*Attorney, Agent, or Firm*—Geoffrey A. Mantooth

[57] ABSTRACT

An automatic dampening system for a lithographic printing press applies a fountain solution to the printing plate on a plate cylinder through the inking rollers. The dampening system has a first roller partially immersed in the fountain solution and a second roller contacting the first roller. The outer surface of the second roller is rotatively coupled to the outer surface of one of the inking rollers such that the rotation of the inking roller will rotate the second roller and the first roller. A bridge roller may be used to bridge any gap between the second roller and the inking roller to maintain the rotative coupling between the rollers. The first and second rollers have outer layers made of elastomeric materials which have a hardness such that a pressure indent is formed in at least one of the outer layers of the rollers at the nip between the first and second rollers and such that the second roller can be rotatably driven by the inking roller. The pressure between the first and second rollers is adjustable to both regulate the size of the pressure indent at the nip between the first and second rollers and to regulate the differential speed between the second roller and the inking roller. By adjusting the pressure between the first and second rollers, the amount of fountain solution that is mixed in with the ink can be controlled.

21 Claims, 5 Drawing Sheets

AUTOMATIC DAMPENING SYSTEM FOR LITHOGRAPHIC PRINTING PRESS

FIELD OF THE INVENTION

The present invention relates to dampening systems for lithographic printing presses, which dampening systems apply a water-based fountain solution to the ink that is used in the printing press.

BACKGROUND OF THE INVENTION

Lithographic printing presses have plural rollers that are used in applying ink to paper. The paper passes between a blanket cylinder and an impression cylinder, wherein the blanket cylinder forms an impression of wet ink on the paper. The blanket cylinder is inked by a plate cylinder and the plate cylinder is inked by a set of inking rollers. Multicolor presses require for each color a set of inking rollers, a blanket cylinder, an impression cylinder, and a plate cylinder.

A chemically treated printing plate that has hydrophilic (or water-loving) areas and separate oleophilic (or oil-loving) areas is attached to the plate cylinder for printing. These areas are arranged in a pattern to produce the desired printed image on the paper. The ink is attracted to the oleophilic areas and repelled from the hydrophilic areas. Thus, as the printing plate rotates, the inking rollers apply ink to the oleophilic areas on the printing plate.

Ink is provided by the manufacturer in a viscous form. It must be applied to the printing plate together with the proper amount of a fountain solution. The fountain solution is made of primarily water into which is mixed other chemicals. If there is too much fountain solution being applied to the printing plate, the print on the paper will lose color and fade. If there is an insufficient amount of fountain solution being applied to the printing plate, the printing plate becomes dirty, reducing the clarity of the print and causing print to appear in nonprint areas.

In the prior art, there are two kinds of dampening systems for applying the fountain solution to the printing plate. One type of dampening system applies the fountain solution directly to the printing plate with a separate set of dampening rollers. This type of dampening system can cause streaking in the printed areas because the fountain solution is unable to be evenly distributed on the printing plate. This type of system is sometimes motor driven.

The other type of dampening system applies the fountain solution to the printing plate indirectly through the ink. The ink on the inking rollers is dampened with the fountain solution before it is applied to the printing plate. This type of system uses a ducting roller to intermittently contact and apply the fountain solution to an inking roller. The ducting roller reciprocates in and out from the inking roller to provide intermittent contact. The ducting roller generally has a metal surface, being either copper-plated or chrome-plated. The ducting roller is driven by a gear coupled to the inking roller. While the ducting roller prior art dampening system does apply the fountain solution in an even distribution to the printing plate, it is inadequate because the amount of fountain solution that is mixed with the ink cannot be controlled with sufficient precision. This mixture, which is applied to the printing plate, contains either too much or too little fountain solution. It is desirable to provide an automatic dampening system that allows accurate application (or metering) of the fountain solution into the ink.

SUMMARY OF THE INVENTION

It is an object of the present invention to provide an automatic dampening system that allows accurate metering of a fountain solution into the ink in a printing press.

The dampening system of the present invention includes a reservoir means, a first roller, a second roller, and pressure setting means. The reservoir means is for holding a fountain solution which is to be applied to the printing press. The reservoir means is mounted to a support means. The first roller is rotatably mounted to the support means and has an outer surface. The first roller is positioned relative to the reservoir means so that the first roller outer surface is partially immersed in the fountain solution. The second roller is rotatably mounted to the support means and also has an outer surface. The second roller is positioned relative to the first roller such that the outer surfaces of the first and second rollers contact at a mixing nip. The outer surfaces of the first and second rollers are made of an elastomeric material which has a relatively soft durometer such that pressure indents are formed in the outer surfaces of the first and second rollers at the mixing nip. The second roller outer surface is adapted to be rotatably coupled to an outer surface of an inking roller such that rotation of the inking roller rotates the second and first rollers. The inking roller is located in the printing press. The outer surface of the second roller has a durometer that allows the second roller to be driven by the inking roller. The pressure setting means allows adjustment of the pressure between the first and second rollers at the mixing nip. The pressure setting means is coupled to at least one of the first and second rollers and allows the one roller to move with respect to the other of the first and second rollers such that when the pressure between the first and second rollers is increased the pressure indents at the mixing nip are enlarged.

In one aspect, the outer surfaces of the first and second rollers are made of different elastomeric materials having different durometers, wherein the durometer of one of the first and second roller outside surfaces is lower than the other of the first and second roller outside surfaces.

In another aspect of the present invention, the pressure setting means adjusts the pressure between the first and second rollers by moving one of the first and second rollers obliquely relative to the other of the first and second rollers.

In still another aspect of the present invention, the dampening system includes a bridge roller located between the second roller and the inking roller. The bridge roller bridges a gap between the second roller and the inking roller so as to maintain the rotative coupling between the second roller and the inking roller.

DESCRIPTION OF PREFERRED EMBODIMENTS

Figure 1:
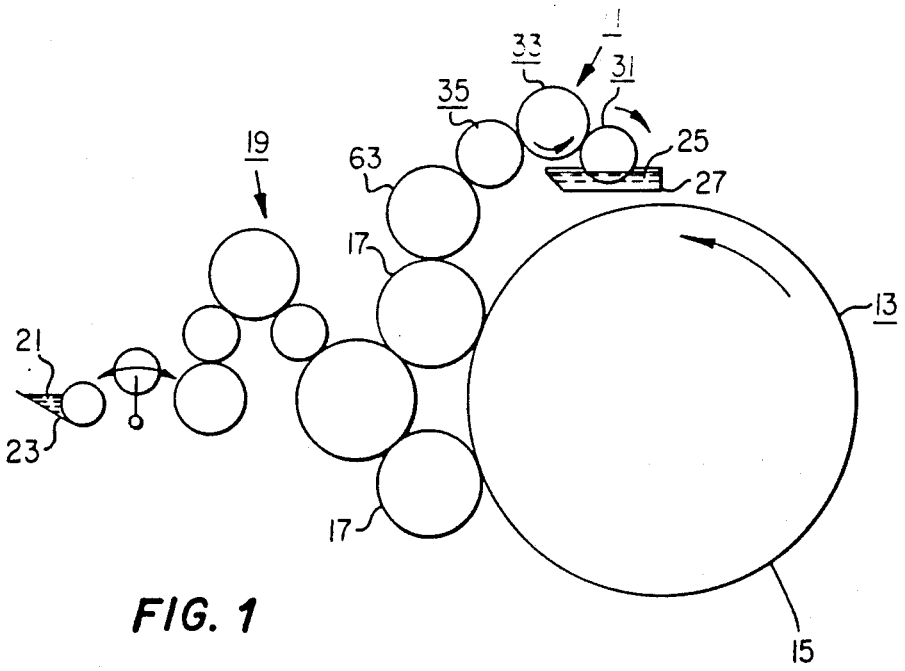
FIG. 1 is a schematic end view of a portion of a lithographic printing press, and in particular a set of inking rollers and a printing plate, in which the dampening system of the present invention, in accordance with a preferred embodiment, has been installed.

In FIG. 1, there is shown a schematic end view of some of the rollers in a lithographic printing press, in which an automatic dampening system 11 of the present invention, in accordance with a preferred embodiment, has been installed. The rollers that are shown in FIG. 1 are used to apply one color of ink to paper. A plate cylinder 13 contains on its printing plate 15 the image which is desired to be transferred to paper. As the plate cylinder 13 rotates counterclockwise, it contacts the form rollers 17. The form rollers are part of a set of inking rollers 19 which apply ink to the outer surface of the plate cylinder 13. Ink 21 is supplied to the various inking rollers from an ink reservoir 23. One of the inking rollers acquires some ink on its outer surface and applies it to the other rollers by rotative contact. The inking rollers 19, and in particular the form rollers 17, apply a smooth even layer of ink to the printing plate 15 on the plate cylinder 13. In FIG. 1, some of the inking rollers are omitted for clarity. The plate cylinder 13 and the inking rollers 19 are conventional.

The dampening system 11 of the present invention applies a fountain solution 25 to the printing plate 15 of the plate cylinder 13 through the inking rollers 19. The printing plate 15 has hydrophilic areas and oleophilic areas. The oleophilic areas attract the ink from the form rollers 17. The hydrophilic areas attract the water-based fountain solution from the form rollers 17, leaving the ink. The oleophilic areas are arranged on the printing plate according to the desired image which is to be printed. The printing plate transfers its ink to a blanket cylinder (not shown) which in turn transfers the ink to the paper.

The dampening system of FIGS. 1-6 includes a fountain solution reservoir 27, support means, a regulator roller 31, a converger roller 33, a bridge roller 35, pressure set means 37, and actuation means 39.

Figure 3:
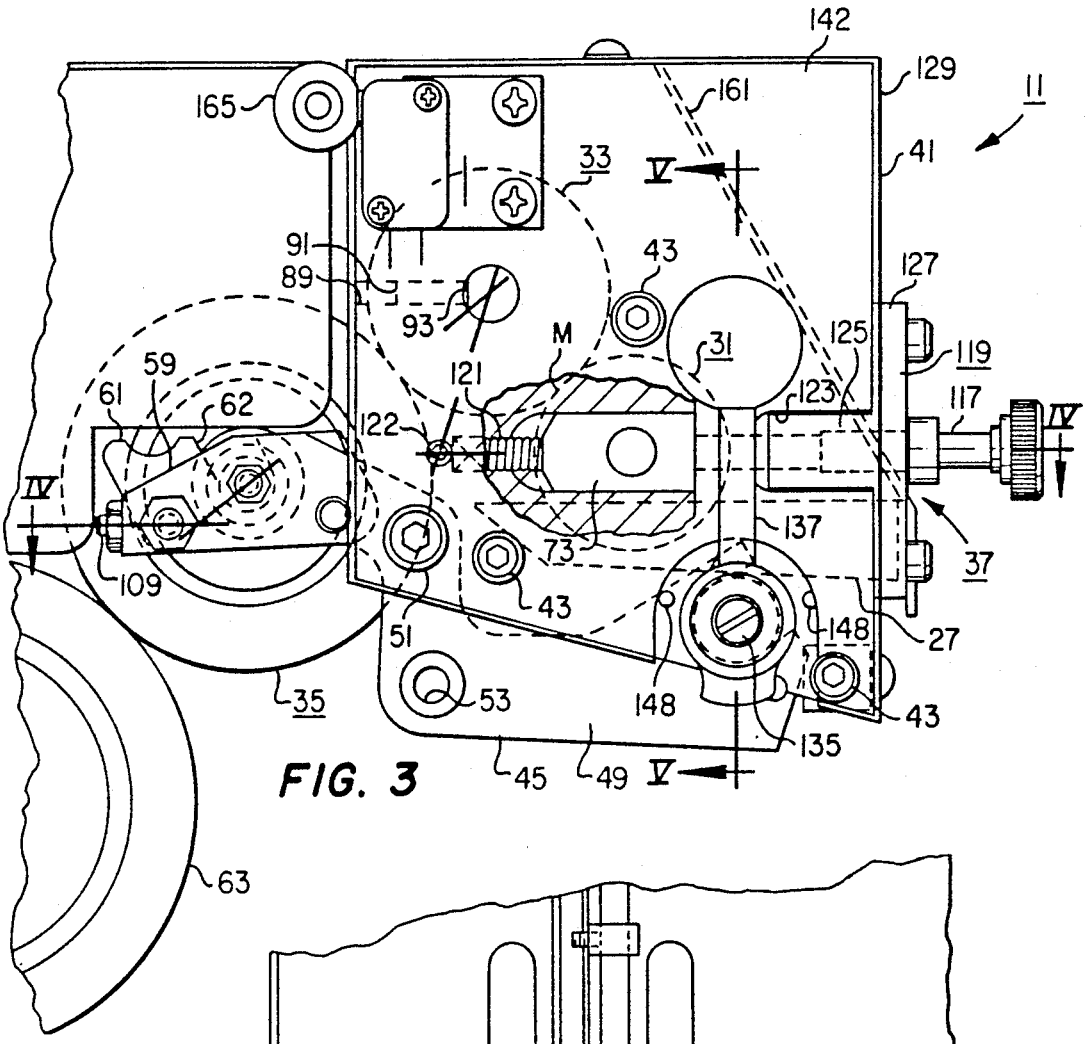
FIG. 3 is an end view of the dampening system, with an orientation corresponding to FIG. 2 and showing the support means and the pressure set means.
Figure 4:
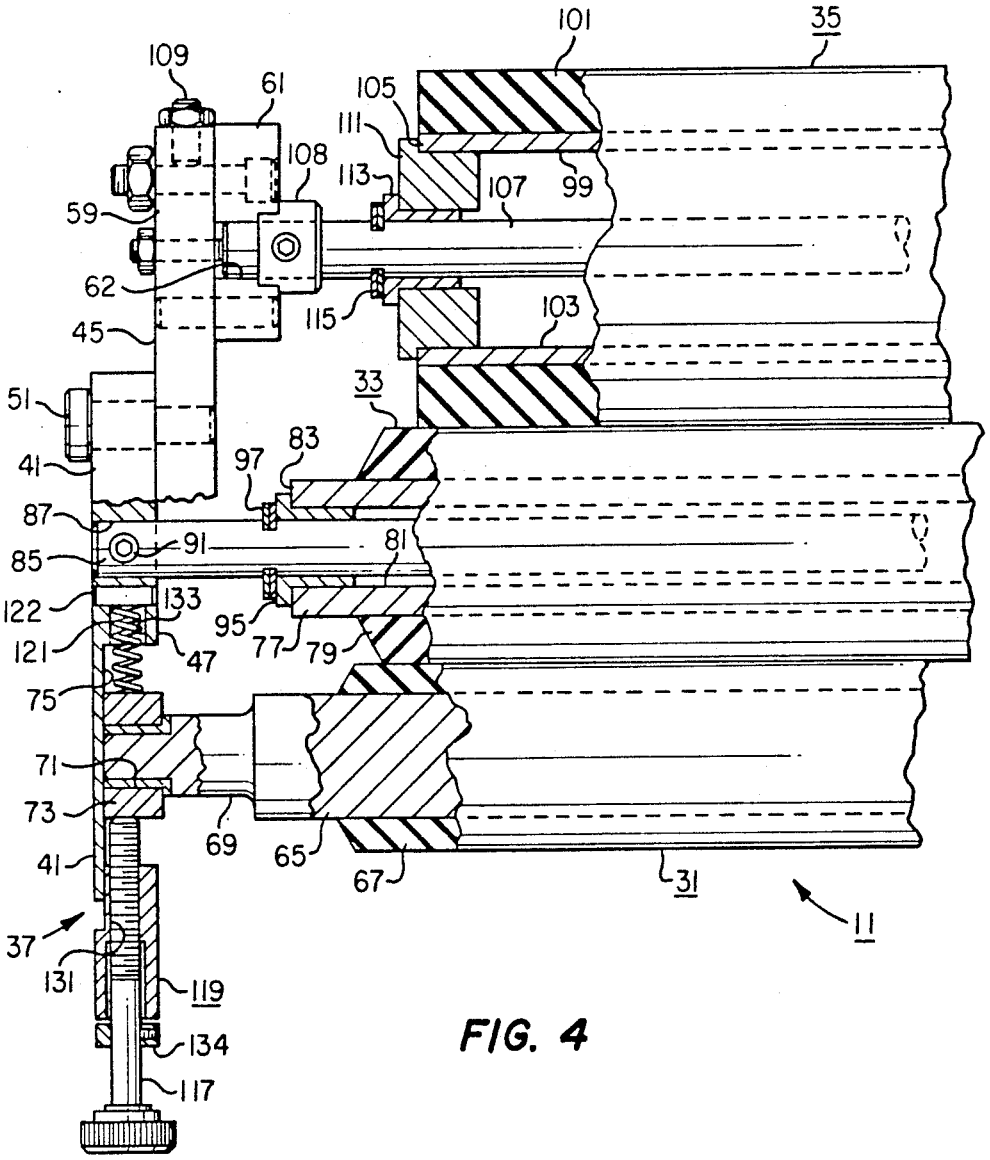
FIG. 4 is a partial cross-sectional plan view of one of the end portions of the rollers and the support means, taken through lines IV—IV of FIG. 3.
Figure 7:
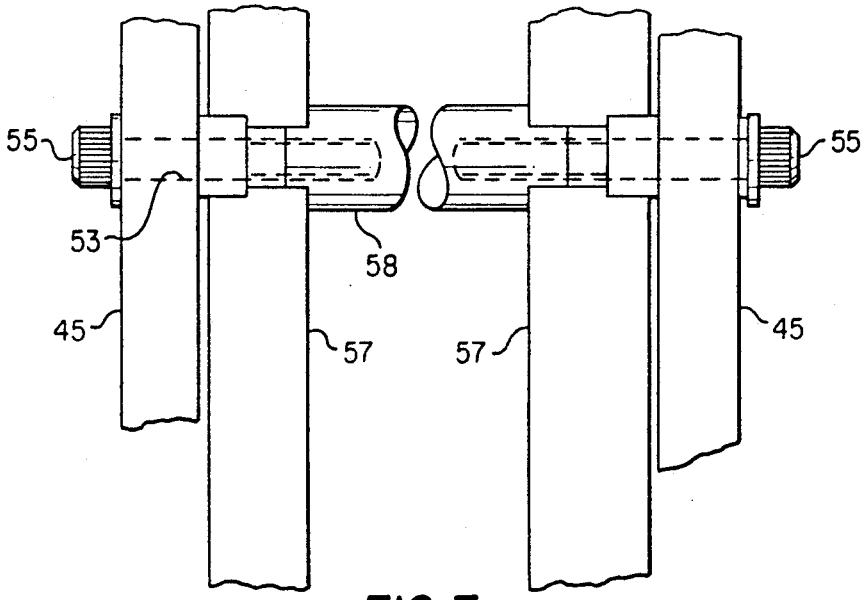
FIG. 7 is a view showing how the mounting bracket mounts to the press frame.

Referring to FIGS. 3 and 4, the support means includes two side frames 41 on each end of the rollers 31, 33, 35 (in the FIGS., only one end of the dampening system is shown, the other end being substantially similar). The side frames 41 are flat plates and are roughly rectangular in shape. The side frames are oriented perpendicularly to the longitudinal axes of the rollers. The side frames 41 are connected together with three tie bars 43 that extend between the side frames 41 to form a rigid framework for rotatably mounting the rollers. One of the tie bars acts as a nip guard to prevent accidental insertion of a hand into the nip M between the regulator and converger rollers 31, 33. The fountain solution reservoir 27 is a pan that is mounted to the support means. A mounting bracket 45 is attached to the inside surface 47 of each side frame 41. Each mounting bracket 45 is a flat plate and has a lower portion 49 that extends below the respective side frame. Each mounting bracket 45 is attached to the respective side frame 41 by a bolt 51 to form a pivot point near the bridge roller 35. Another place where each mounting bracket 45 is coupled to the respective side frame 41 is at the actuation shaft 135. The lower portion 49 of each mounting bracket 45 has a circular opening 53 for receiving a bolt 55 for mounting the dampening system to the press frame 57 (see FIG. 7). The bolts 55 thread into a rod 58 that extends between the two mounting brackets 45. Each mounting bracket 45 also has a lateral portion 59 that extends from the side frame 41 towards the bridge roller 35. A support bracket 61 is mounted to the inside surface of each mounting bracket 45. The support brackets 61 are used to support and retain the bridge roller 35.

Figure 2:
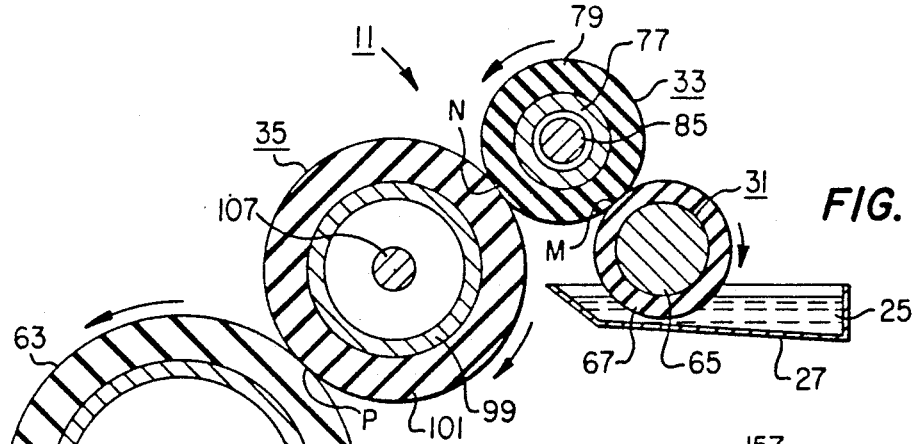
FIG. 2 is a cross-sectional end view of the rollers of the dampening system.

Referring to FIGS. 2 and 4, the regulator, converger, and bridge rollers 31, 33, 35 are elongated cylinders rotatably mounted to the support means so that the longitudinal axes of the rollers are parallel to each other. The regulator roller 31 is located partially within the fountain solution reservoir 27 such that the lower portion of the outer surface of the regulator roller is immersed in the fountain solution 25. Located above the regulator roller 31 is the converger roller 33, which contacts the regulator roller along a mixing area or nip M. The bridge roller 35 is located below the converger roller 33 such that the two rollers contact each other along a nip N. The bridge roller 35 is used to bridge the gap between the converger roller 33 and the inking roller 63.

The regulator roller 31 includes a metal inner core 65 and an outer layer 67 of elastomeric material. The inner core 65 is a cylinder having two end portions 69 (only one of which is shown in the FIGS.). The end portions 69 are reduced in diameter from the central portion. The outer layer 67, which has a smooth outer surface, completely encompasses the circumference of the inner core 65. Each end portion 69 of the inner core 65 receives an oil-impregnated brass bushing 71, which bushing is in turn received by a slide block 73. Each slide block 73 is located in a guideway or slot 75 formed in the inside surface 47 of the respective side frame 41.

The converger roller 33 includes a metal inner core 77 and an outer layer 79 of elastomeric material. The inner core 77 is a hollow cylinder having a cylindrical inner passage 81 extending between its two ends 83. A shaft 85 is located within the inner passage 81. The shaft 85 is longer than the inner core 77 such that both ends of the shaft protrude out of the passage. The shaft 85 extends between the side frames 41 where each end 83 of the shaft is received by a cylindrical opening 87 in the respective side frame. Each opening 87 has a transversely oriented threaded bore 89 for receiving a set screw 91 (see FIG. 3). Each set screw 91 bears on a flat surface 93 on the respective end of the shaft 85 to retain the shaft in position. The inner core 77 is rotatably coupled to the shaft 85 by way of an oil-impregnated brass bushing 95 on each end 83 of the inner core. Each end 83 of the inner core passage 81 receives a bushing 95 which in turn receives the shaft 85. The converger roller 33 is retained in a position that is located between the two side frames 41 by a retaining clip 97 and a spacer on each end of the roller. Each retaining clip 97 and spacer are retained in a circumferential groove on the shaft. The spacers abut against the respective bushing. The outer layer 79, which has a smooth outer surface, completely encompasses the circumference of the inner core 77. The converger roller 33 is located relative to the regulator roller 31 such that their respective outer surfaces contact each other.

The bridge roller 35 also includes a metal inner core 99 and an outer layer 101 of elastomeric material. The inner core 99 is a hollow cylinder having a cylindrical inner passage 103 extending between its two ends 105. A shaft 107 is located within the inner passage 103. The shaft 107 is longer than the inner core 99 such that both ends of the shaft extend out from the inner core. The ends of the shaft are received by slots 62 in the support brackets 61. The shaft 107 is retained in the support bracket slots 62 by way of locking collars 108. The support brackets are movable with respect to the mounting brackets 45 so as to allow the alignment of the bridge roller 35 with the converger roller 33. By adjusting a screw 109 on each support bracket 61, the shaft 107 can be made parallel to the converger roller shaft 85. The inner core 99 is rotatably coupled to the shaft 107 by way of an adaptor 111 and an oil-impregnated brass bushing 113 on each end of the inner core. Each end of the inner core passage 103 receives an adapter 111 which in turn receives a bushing 113. The shaft 107 extends through the bushing 113. The bridge roller 35 is retained in a position on the shaft 107 between the two mounting brackets 45 by a retaining clip 115 and a spacer on each end of the roller. Each retaining clip 115 and spacer is retained in a circumferential groove on the shaft 107. The spacers abut against the bushings 113. The respective bushing 113 prevents outward movement of the respective adaptor 111 which in turn prevents outward movement of the converger roller 35. The outer layer 101, which has a smooth outer surface, completely encompasses the circumference of the inner core 99. The bridge roller 35 is located relative to the converger roller 33 such that their respective outer surfaces contact each other.

The regulator, converger, and bridge rollers 31, 33, 35 have outer layers 67, 79, 101 that are made from elastomeric materials, such as flexible polyvinyl chloride (PVC), flexible polyurethane, or natural rubber. The elastomeric layers provide relatively soft outer surfaces for the rollers enabling the formation of pressure indents on the rollers in the mixing area or nip M between the regulator and converger rollers 31, 33, in the nip N between the bridge and converger rollers 35, 33, and also in the nip P between the bridge roller 35 and the inking roller 63. (Although in FIG. 2 the deformations of the outer layers due to pressure indents are shown as being slight, the deformations could be lesser or greater.) These pressure indents are used in metering the proper amount of fountain solution into the ink. The outer layers 67, 79 of the regulator and converger rollers 31, 33 preferably have different hardnesses or durometers such that the durometer of one of the rollers is harder than the durometer of the other roller. Likewise, the outer layers 79, 101 of the converger and bridge rollers 33, 35 have different durometers such that the durometer of one of the rollers is harder than the durometer of the other roller. These differences in durometers between contacting rollers enhances the formation of pressure indents in one of the two contacting rollers while minimizing the amount of pressure required to achieve a particular size of indentation.

In the preferred embodiment, the outer layer 79 of the converger roller 33 has a durometer of 50, and the outer layers 67, 101 of the regulator and bridge rollers 31, 35 each have a durometer of 30. Alternatively, the converger roller could be made softer than the regulator roller, so that the converger roller has a durometer of 30 and the regulator roller has a durometer of 50. We have tested a range of outer layer durometers for the regulator, converger, and bridge rollers using outer layers made of elastomeric urethane, elastomeric PVC, and buna-N rubber (a synthetic rubber). The results of our tests are as follows: with the regulator and bridge rollers 31, 35 having a durometer of 30, and the converger roller having a durometer of 80, the bridge roller would rotate, but the converger roller would not rotate. The bridge roller 35 was unable to rotate the converger roller 33. Because the regulator roller 31 is driven by the converger roller 33, the regulator roller likewise did not rotate and was therefore unable to pick up any fountain solution 25 from the reservoir 27. With the regulator and bridge rollers having a durometer of 30 and the converger roller having a durometer of 60, the operation of the dampening system was marginal, but still suffered from the same rotation problem (or lack of rotation) of the converger roller. With the regulator and bridge rollers having a durometer of 30 and the converger roller having a durometer of 50, the most satisfactory results were obtained. Precise control of the application of the fountain solution into the ink was achieved with minimal amounts of pressure. With the regulator and bridge rollers having a durometer of 30 and the converger roller having a durometer of 30, the operation of the dampening system was also satisfactory. However, a large amount of pressure was required to achieve pressure indents of the rollers 31, 33, 35.

Commercially available rollers having elastomeric outer layers come rated at a specific durometer with a tolerance of $\pm 5$ durometer. Furthermore, we believe that a combination of one 20 durometer roller with a 40 durometer roller would operate satisfactorily. Thus, the soft roller could have a durometer in the range of 20–35 durometer and the hard roller could have a durometer in the range of 40–55 durometer. It is to be understood that other roller durometers could be used, which rollers have pressure indents at the mixing nip M for mixing and pressure indents for rotative coupling.

We have also tested a range of outer layer thicknesses. The outer layer 67 of the regulator roller 31 was varied between $\frac{3}{8}$–$\frac{1}{4}$ inches, the outer layer 79 of the converger roller 33 was varied between 3/16–$\frac{1}{2}$ inches, and the outer layer 101 of the bridge roller 35 was varied between $\frac{3}{8}$–$\frac{1}{4}$ inches. All of the thicknesses tested produced satisfactory results.

The pressure set means 37 is a mechanism that provides for adjustments in the pressure between the regulator and converger rollers 31, 33 to achieve the desired pressure indents in their outer layers. The axis of rotation of the converger roller 33 is fixed relative to the support means 29. However, the axis of rotation of the regulator roller 31 is movable relative to the support means 29 because the inner core ends 69 are rotatively coupled to slide blocks 73 which are in turn movable in guideways 75 in the side frames 41.

The pressure set means 37 includes the slide blocks 73, adjusting screws 117, retainers 119, and springs 121. The guideways 75 that receive the slide block 73 are formed in the inside surface 47 of the respective side frame 41. In the preferred embodiment, the guideways 75 are oriented so that the slide blocks 73 move toward the shaft 85 at an angle instead of directly toward the shaft. In the preferred embodiment, this angle is defined by the shaft 85 (see FIG. 3), the shaft 65, and a respective pin 122, with the shaft 65 being at the apex of the angle. This angle, which in the preferred embodiment is 50 degrees, allows the establishment of a more easily adjustable control when the pressure between the regulator and converger rollers is adjusted with the adjusting screws 117. With an angle of 50 degrees, the adjusting screw must be rotated more to move the slide block 73 and the shaft 65 to obtain the same pressure as if the angle was 0 degrees (i.e. the slide block moved directly toward the shaft 85). Thus, more precision in the pressure adjustment can be obtained by moving the axis of rotation of the regulator roller obliquely to, rather than directly toward or away from, the axis of rotation of the converger roller.

The side frames 41 each have a notch 123 in the front edge, which notch extends to the respective guideway 75. The retainers 119 are T-shaped, each of which has a stem portion 125 and two arms 127. The stem portion 125 of each retainer is inserted into the respective notch 123; the length of each stem portion 125 is such that the end of the stem portion is received by the respective guideway 75. The retainer arms 127 are bolted to the front edges 129 of the side frames 41.

Each retainer stem portion 125 has a threaded bore 121 for receiving a threaded adjusting screw 117. The end of each screw 117 contacts the respective slide block 73. The slide blocks 73 are biased by the springs 121 so as to force the regulator roller 31 away from the converger roller 33. The springs 121, which force the slide blocks 73 toward the adjusting screws 117, are located in the guideways 75. One end of each spring 121 is received by a respective bore 133 located at the closed end of the respective guideway 75. As each adjusting screw 117 is tightened, the force of the respective spring 121 is overcome, pushing the respective end of the regulator roller 31 toward the converger roller 33. Conversely as each adjusting screw 117 is loosened, the respective spring 121 pushes the respective slide block 73 and the respective end of the regulator roller 31 away from the converger roller 33. Each adjusting screw has a limit collar 134 for limiting the inward travel of the screw 117.

Figure 5:
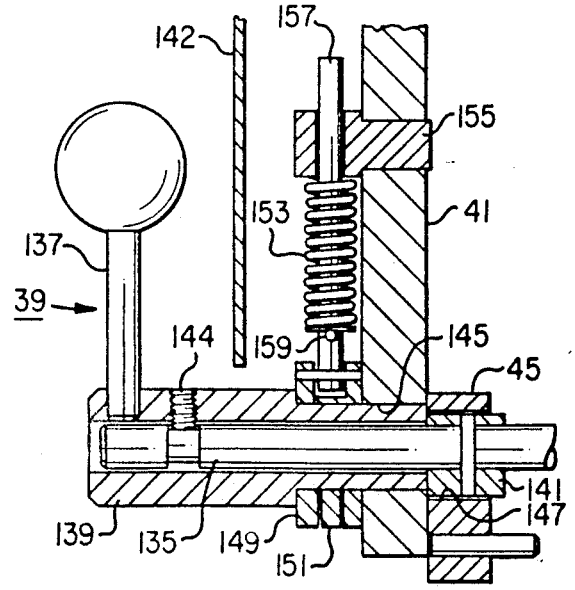
FIG. 5 is a cross-sectional view, taken through lines V—V of FIG. 3, showing the actuation means.

There is also provided actuation means 39 for actuating the dampening system 11 (see FIGS. 3 and 5). When the dampening system 11 is mounted onto the press frame 57, the bridge roller 35 continuously contacts the inking roller 63. However, the converger and regulator rollers 33, 31 can be moved between engaged and disengaged positions relative to the bridge roller 35. The converger and regulator rollers 33, 31 are mounted to the side frames 41 while the bridge roller 35 is mounted to the mounting brackets 45. The respective side frames 41 are pivotally coupled to the respective mounting brackets 45 at the pivot bolts 55. The mounting brackets 45 are fixed to the press frame 57.

The actuation means 39 includes a shaft 135, a handle 137, a sleeve 139, cams 141, and retaining means. The shaft 135 which extends between the two side frames 41 is received by circular openings 145, 147 in the side frames 41 and the mounting brackets 45. The shaft 135 is parallel to the roller shafts and is located beneath the fountain solution reservoir 27. On the operator's side of the press, the end of the shaft 135 is received by the sleeve 139. One end of the sleeve 139 is received by the opening 145 in the respective side frame 41. The handle 137, which is perpendicular to the shaft 135, is coupled to the sleeve 139, while the sleeve 139 is coupled to the shaft 135 with a set screw 144. A protective sheet metal cover 142 isolates the handle 137 from the rest of the dampening system. The shaft 135 is coupled to the eccentric cams 141; there is a cam 141 rotatably mounted in each mounting bracket opening 147. Thus, as the handle 137 is moved, the sleeve 139 and the shaft 135 rotate. As the shaft 135 rotates, the cams 141 rotate causing the side frames 41 to pivot about the pivot bolts 55. The movement of the handle 137 is limited by two pins 148 (see FIG. 3) that project out from the side frame 41. To engage the converger roller 33 with the bridge roller 35, the handle 137 is pushed toward the bridge roller wherein the side frames 41 are pivoted counterclockwise (with respect to the orientation of FIG. 3). The regulator and converger rollers 31, 33 always contact, regardless of the position of the side frame 41. To disengage the converger roller 33 from the bridge roller 35, the handle 137 is pulled away from the bridge roller wherein the side frames 41 are pivoted clockwise. The bridge roller 35 idles or rotates continuously against the inking roller 63, regardless of the position of the side frames 41.

The retaining means retains the handle 137 down against the limit pins 148, preventing movement of the handle. The retaining means includes a collar 149 coupled to the sleeve 139 by a set screw 151, a compression spring 153, and a pivotable anchor pin 155 mounted into the side frame 41. A rod 157 is pivotally coupled to the collar 149 and extends to the anchor pin 155, where the rod 157 is slidably coupled to the pin 155. The rod 157 has a perpendicular pin 159. The compression spring 153 is located on the rod 157 between the pin 159 and the anchor pin 155 where it is maintained under compression. The spring 153 pushes down on the collar 149, forcing the handle 137 down against the respective limit pins 148.

Figure 6:
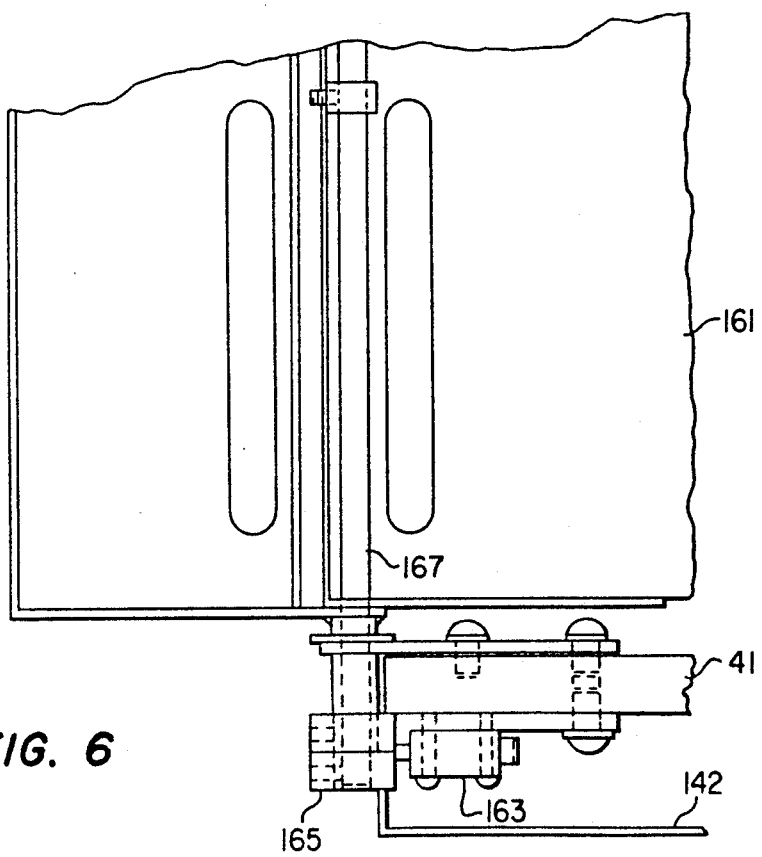
FIG. 6 is a plan view of the dampening system of FIG. 3, showing an end portion of the cover arrangement.

In FIG. 6, there is shown the cover arrangement of the dampening system 11. A cover 161 is provided for safety reasons. The cover 161 has a safety switch 163 which stops the press if the cover is opened during operation. The switch 163 is actuated by a cam 165 that is coupled to a shaft 167. The shaft 167 rotates when the cover 161 is rotated to open or closed positions.

The dampening system is installed onto the printing section of a printing press by installing the mounting brackets 45 onto the press frame 57 as described above. The inking rollers 19 and the plate cylinder 13 make up part of the press.

The pressure indent on the bridge roller 35 at nip N is adjusted during installation. To adjust the pressure between the bridge roller 35 and the converger roller 33, the set screw 144 in the actuation means (see FIG. 5) is loosened. This uncouples the shaft 135 from the sleeve 139 and the handle 137. As shown in FIG. 3, the end of the shaft 135 has a slot for receiving a slotted screwdriver. The shaft 135 is rotated to either increase or decrease the pressure between the converger and bridge rollers 33, 35. When the shaft is set in the desired position, the set screw 144 is retightened.

The bridge roller 35 has a pressure indent formed at nip P. The bridge roller 35 is softer than the inking form roller 63 and so has a pressure indent formed in its outer layer 101. In the preferred embodiment, the ends of the shaft 107 are movable within a slot 62 within the support bracket 61. This allows the bridge roller 35 to move up and down as the inking form roller 63 moves up and down during operation. The bridge roller 35 moves tangentially to the converger roller 33 to maintain a constant pressure therebetween. Gravity pulls the bridge roller down and maintains a pressure indent on the bridge roller. In other embodiments, springs may be used to maintain the pressure indent on the bridge roller.

The operation of the dampening system of the present invention will now be described with reference to FIGS. 1-5. With the dampening system installed on the printing press, the reservoirs are checked and filled if necessary. Automatic filling means, such as an inverted supply bottle (not shown), can be used to fill the fountain solution reservoir 27. The dampening system is engaged by moving the handle 137 to engage the converger roller 33 with the rotating bridge roller 35. The regulator, converger, and bridge rollers 31, 33, 35 are all driven by the inking roller 63. Thus, the inking roller directly drives the bridge roller 35 and indirectly drives the converger roller 33 through the bridge roller 35 and indirectly drives the regulator roller 31 through the bridge and converger rollers. The converger roller is rotatively coupled to the inking roller through the bridge roller. With respect to the orientation shown in FIGS. 1-3, the regulator roller 31 and the bridge roller 35 rotate clockwise, while the converger roller 33 and the inking roller 63 rotate counterclockwise. The bushings 71, 95, 113 upon which the rollers 31, 33, 35 rotate provide some frictional resistance to rotation. As a result, the bridge roller 35 rotates at a slightly slower speed than the inking roller 63 and the converger roller 33 rotates at a slightly slower speed than the bridge roller 31. Thus, there are differential roller speeds at the nip P between the inking roller 63 and the bridge roller 35 and at the nip N between the converger roller 33 and the bridge roller 35.

As the regulator roller 31 rotates, it brings up some of the fountain solution from the reservoir 27 to the mixing area nip M. The converger roller brings ink to the mixing area M; the converger roller having acquired the ink from the inking roller 63 via the bridge roller 35. The ink and the fountain solution are mixed together at the mixing area M between the regulator and converger rollers 31, 33. The mixing area M is formed by a pressure indent in the outer layer 67 of the regulator roller 31. The soft outer layer 67 of the regulator roller is indented by the harder outer layer 79 of the converger roller 33. The elastomeric outer layer of the converger roller also has a pressure indent, although it is smaller than the pressure indent on the regulator roller.

The application, or metering, of the fountain solution into the ink that is applied to the plate cylinder 13 can be controlled precisely by manipulating the adjusting screws 117. The operator checks the appropriateness of the ink-fountain solution mixture that is applied to the plate cylinder 13 by visually examining paper that has been printed on by the printing plate. If the color of the ink fades in the printed areas of the paper, there is too much fountain solution in the ink. The amount of fountain solution is decreased by tightening the adjusting screws 117 to increase the pressure between the regulator and converger rollers 31, 33. The two adjusting screws 117 should be tightened to obtain the needed pressure between the regulator and converger rollers 31, 33 to increase the dwell time in nip M. It is not necessary to maintain the inner core 65 in a parallel relation to the shaft 85. (Thus, the dampening system is adaptable to print runs where the ink is run thicker or heavier on one end of the rollers than on the other end.) The increased pressure between the regulator and converger rollers 31, 33 enlarges the pressure indent of the regulator roller 31, thereby increasing the dwell time between the regulator and converger rollers.

Dwell time is the amount of time a point on the outer surface of a roller is located within a nip between two rollers. The longer the dwell time is between rollers, the longer a point on the outer surface of each of the rollers will remain in the nip. (In comparison, the dwell time of a nip between two metal-plated, or hard, rollers is very short.) Pressure indents increase the dwell time; the larger the pressure indent, the larger the dwell time. Differential roller speeds also increase dwell time. The greater the differential speed between two rollers, the longer the dwell time.

At the next nip N, between the converger and bridge rollers 33, 35, and the remaining nips separating the bridge roller from the printing plate, the fountain solution is further mixed into the ink. At the nip N between the bridge and converger rollers, a pressure indent is formed in the bridge roller because the outer layer 101 of the bridge roller 35 is softer than the outer layer 79 of the converger roller. The pressure between the bridge roller and the converger roller is typically adjusted during installation of the dampening system. A larger pressure indent on the bridge roller has a longer dwell time than the dwell time of a smaller pressure indent. The dwell time between the bridge and converger rollers is also increased by increasing the pressure between the regulator and converger rollers. By increasing the pressure, the regulator roller 31 acts as a brake on the converger roller 33 slowing the converger roller down, relative to the bridge roller 35. This is in addition to the frictional resistance offered by the bushings 95. This increases the dwell time between the converger and bridge rollers.

Thus, when the adjusting screws 117 are tightened, the dwell times at the nips M, N increase, thereby reducing the amount of fountain solution being mixed into the ink. By controlling the dwell time with the adjusting screws 117, the application of the fountain solution into the ink can be controlled. Fine metering adjustments can be made during printing with the adjusting screws 117. By providing a wide range of dwell times, with a pressure set means having a high resolution of control, the application of the fountain solution into the ink can be precisely controlled.

If, in checking the appropriateness of the ink-fountain solution mixture on a printed paper, there is ink appearing in nonprint areas, then there is too little fountain solution in the ink. The amount of fountain solution is increased by loosening the adjusting screws 117 to decrease the pressure between the regulator and converger rollers 31, 33. The decreased pressure shrinks the pressure indent on the regulator roller 31, decreasing the dwell time between the regulator and converger rollers. At the next nip N the difference in rotational speeds between the bridge roller and converger roller decreases, decreasing the dwell time, which assists in increasing the amount of water being metered into the ink. Thus, when the adjusting screws 117 are loosened, the dwell times at the nips M, N decrease, thereby increasing the amount of fountain solution that is mixed in with the ink.

Figure 8:
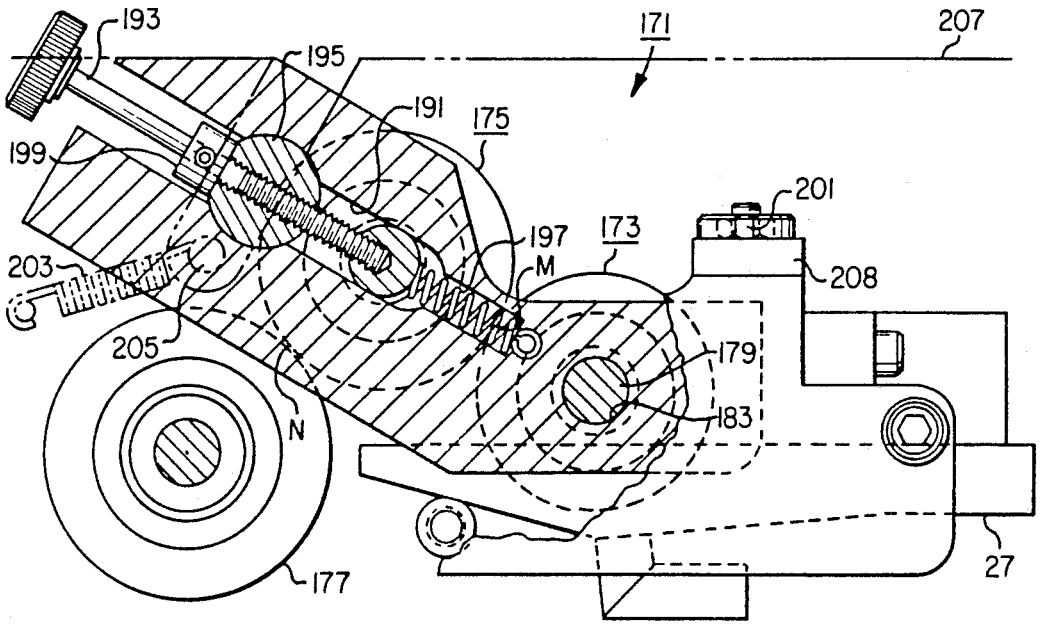
FIG. 8 is an end view of the dampening system, in accordance with another embodiment.
Figure 9:
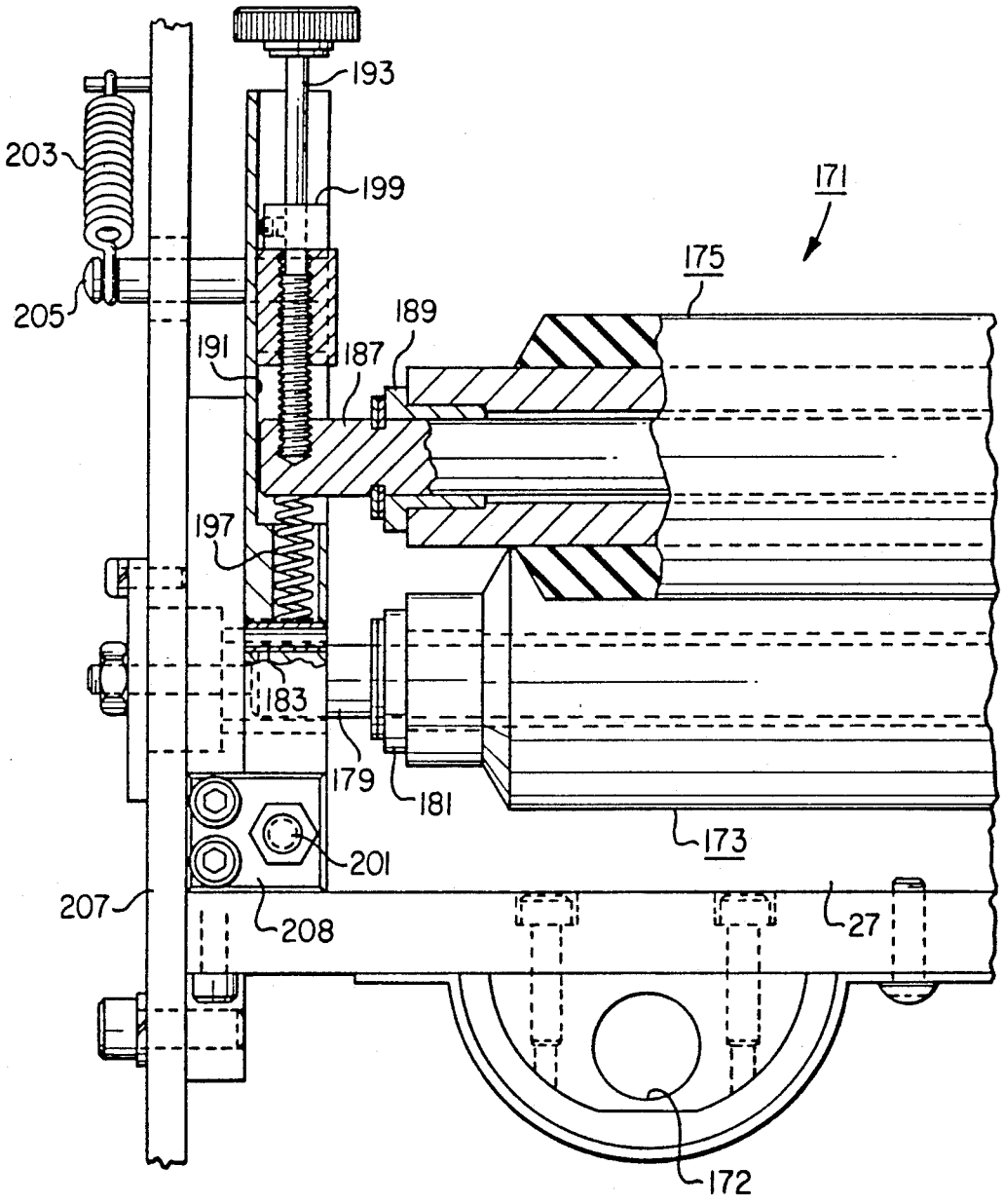
FIG. 9 is a partial cross-sectional plan view of one of the end portions of the dampening system of FIG. 8.

In FIGS. 8 and 9, there is shown the dampening system 171 in the present invention, in accordance with another embodiment. The dampening system 171, which is similar to the dampening system 11 of FIGS. 1–7, has a regulator roller 173 and a converger roller 175, but does not have a bridge roller. In the embodiment shown in FIGS. 8 and 9, the converger roller 175 can be placed in direct contact with the inking roller 177, eliminating the need for a bridge roller. A bridge roller is required if there is a gap between the converger roller and inking roller of a particular press. The diameter of the bridge roller is large enough to span the gap. The fountain solution reservoir 27 has a fitting 172 for receiving an inverted supply bottle of fountain solution.

The regulator and converger rollers have outer layers of elastomeric material, preferably with different hardnesses. In the preferred embodiment, the durometer of the outer layer of the regulator roller is 50 and the durometer of the converger roller is 30. Alternatively, the regulator roller 173 could be softer than the converger roller 175. This would depend on the specific inking roller that would form a nip with the converger roller.

The regulator roller 173 is rotatably mounted to the support means so as to be partially immersed in the fountain solution reservoir 27. The regulator roller 173 is similar to the regulator roller 31 shown in FIGS. 2–4. The regulator roller, which has a hollow inner core, is rotatably mounted onto a shaft 179 via oil-impregnated brass bushings 181. The respective ends of the shaft 179 are received by openings 183 and respective hanger brackets 185 on each end.

The converger roller 175 is rotatably mounted to a shaft 187 by oil-impregnated brass bushings 189. The ends of the shaft 187 are received by guideways 191 or slots in the inside surfaces of the hanger brackets 185. The pressure set means adjusts the pressure between the regulator and converger rollers 173, 175 by moving the shaft 187 of the converger roller 175 relative to the shaft 179 of the regulator roller 173. Two adjusting screws 193, one on each end of the shaft 187, are used to adjust the pressure between the rollers. Each adjusting screw 193 is threaded through a retainer 195 that is fixed within the respective hanger bracket 185. The ends of the adjusting screws 193 contact the shaft 187. Springs 197 provide a biasing force for the adjusting screws 193 to push against. A limit collar 199 is provided on each adjusting screw 193 to limit the amount of travel of the adjusting screws. To increase the pressure between the regulator and converger rollers 173, 175, the adjusting screws 193 are tightened, forcing the converger roller into the regulator roller, and increasing the size of the pressure indent on the regulator roller.

The pressure between the converger roller 175 and the inking roller 177 is adjusted with the screws 201, in each adjusting bracket 208. The hanger bracket 185 pivots about the regulator roller shaft 179. Thus, as the screw 201 is tightened, it pushes down on the hanger bracket, causing the hanger bracket to rotate clockwise slightly (with reference to the orientation of FIG. 8), wherein the converger roller 175 moves away from the ink roller 177 and the pressure indent on the converger roller is lessened. If the screw 201 is loosened, the hanger bracket 185 is rotated counterclockwise by a spring 203 which couples the hanger bracket to the press frame 207. The spring is attached to a pin 205 that projects out of the hanger bracket 185. As the screw 201 is loosened, the hanger bracket 185 moves toward the inking roller 177, increasing the pressure between the two rollers and increasing the pressure indent on the converger roller. Each hanging bracket has a spring 203.

The dampening system 171 is provided with actuation means (not shown) to engage and disengage the converger roller 175 from the rotating inking roller 177. The dampening system 171 operates as described above with reference to the dampening system 11 of FIGS. 1–7.

The dampening system of the present invention provides for accurate metering of a fountain solution into the ink so that the ink-fountain solution mixture that is applied to the printing plate on the plate cylinder will produce a high quality printed image on paper running through the press. Accurate metering is achieved by providing two rollers, one of which is partially immersed in the fountain solution. A third roller may be provided to bridge any gap between the dampening rollers and the inking rollers. The dampening rollers each have a soft outer layer such that pressure indents are made in the rollers at the nip between the rollers. By allowing the outer layer of the rollers to be deformed at the nip, superior control can be achieved in metering the amount of fountain solution into the ink. As pressure between the rollers is changed with the pressure setting means, the amount of fountain solution being mixed into the ink is regulated. The amount of pressure required for control can be minimized by using dampening rollers of different durometers, so that one roller is harder than the other roller. The amount of fountain solution being mixed into the ink is further controlled at the next nip, by changing differential speed between the rollers. This is achieved by using friction means for providing friction to the rotation of the dampening rollers and also by changing the pressure between the dampening rollers to act as a brake. With these two features, an external braking mechanism is not required. Further refinement of metering control is achieved by moving the axis of rotation of one dampening roller obliquely to, instead of directly toward or away from, the dampening roller.

In addition, by providing soft surfaces or outer layers to the dampening rollers, the dampening rollers can be driven by contacting the inking rollers. The soft outer layers allow the formation of a pressure indent in the respective dampening roller, at the nip between the respective dampening roller and the inking roller. This pressure indent provides for rotative coupling between the rollers. This eliminates the need for independent drive means such as gearing or a separate motor, and greatly simplifies the dampening system.

The dampening system of the present invention can be retrofitted onto existing printing presses, as well as installed in new presses. The dampening system is located at a printing section in a press, with each printing section having its own dampening system. Because there are many different kinds of lithographic printing presses, the dampening system is designed to fit within the available space of the particular press. Thus, in some presses, as in FIGS. 8 and 9, a bridge roller is not required because the converger roller can be brought into direct contact with the inking roller. In other presses, a bridge roller is needed to span the gap between the inking and converger rollers. Because the size of the gap may vary from press to press, the diameter of the bridge roller depends on the size of the gap. Likewise, the diameters of the regulator and converger rollers depend on the amount of space available within the particular press. The dampening system may be installed in any one of a number of locations in a set of inking rollers. Thus, the dampening system rollers can be rotatively coupled with a form roller, an oscillating roller, an idler roller, etc. The dampening system could even be coupled to the plate cylinder, via an extra form roller, in addition to the set of inking rollers.

The foregoing disclosure and the showings made in the drawings are merely illustrative of the principles of the invention and are not to be interpreted in a limiting sense.

We claim:

1. An automatic dampening system for a lithographic printing press, comprising:

a) reservoir means for holding a fountain solution which is to be applied to said printing press, said reservoir means being mounted to a support means;

b) a first roller rotatably mounted to said support means, said first roller having an outer surface, said first roller being positioned relative to said reservoir means so that said first roller outer surface is partially immersed in said fountain solution;

c) a second roller rotatably mounted to said support means, said second roller having an outer surface, said second roller being positioned relative to said first roller such that the outer surfaces of said first and second rollers contact at a mixing nip;

d) said outer surfaces of said first and second rollers being made of an elastomeric material, said elastomeric material having a relatively soft durometer such that pressure indents are formed in said outer surfaces of said first and second rollers at said mixing nip;

e) said second roller outer surface being adapted to be rotatably coupled to an outer surface of an inking roller such that rotation of said inking roller rotates said second and first rollers, said inking roller being located in said press, said outer surface durometer of said second roller allowing said second roller to be driven by said inking roller;

f) pressure setting means for adjusting the pressure between said first and second rollers at said mixing nip, said pressure setting means coupled to at least one of said first and second rollers and causing said one roller to move with respect to the other roller of said first and second rollers, wherein when the pressure between the first and second rollers is increased said pressure indents at said mixing nip are enlarged.

2. The dampening system of claim 1 wherein said outer surfaces of said first and second rollers are made of different elastomeric materials having different durometers, wherein the durometer of one of said first and second roller outside surfaces is lower than the other of said first and second roller outside surfaces.

3. The dampening system of claim 2 wherein said pressure setting means adjusts the pressure between said first and second rollers by moving the axis of rotation of one of said first and second rollers obliquely to the axis of rotation of the other of said first and second rollers.

4. The dampening system of claim 3 wherein said pressure setting means comprises:

a) an adjusting screw located at each end of said other roller, said adjusting screws being threaded and being received by respective threaded bores in said support means, with the ends of said adjusting screws being coupled with the ends of said other roller;

b) said ends of said other roller being movable in guideways and said support means;

c) spring means for forcing said ends of said other roller into coupling engagement with said adjusting screw ends.

5. The dampening system of claim 4 further comprising actuating means for moving said first and second rollers into engaged and disengaged positions, wherein when said first and second rollers are in said engaged position, said second roller is rotatably coupled with said inking roller, and when said first and second rollers are in said disengaged position, said second roller is uncoupled from said inking roller.

6. The dampening system of claim 1 wherein said outer surfaces of said first and second rollers have substantially the same durometers.

7. The dampening system of claim 1 further comprising a bridge roller located between said second roller and said inking roller, said bridge roller bridging a gap between said second roller and said inking roller so as to maintain the rotative coupling between said second roller and said inking roller.

8. An automatic dampening system for a lithographic printing press, comprising:

(a) reservoir means for holding a fountain solution which is to be applied to said printing press, said reservoir means being mounted to a support means;

(b) a first roller rotatably mounted to said support means, said first roller having an outer surface that is made of a first elastomeric materials, said first roller being positioned relative to said reservoir means so that a portion of said first roller outer surface comes in contact with said fountain solution in said reservoir means;

(c) a second roller rotatably mounted to said support means so as to be generally parallel with said first roller, said second roller having an outside surface that is made of a second elastomeric materials, said second roller being positioned relative to said first roller so that portions of said outer surfaces of said first and second rollers contact;

(d) one of said first and second elastomeric materials having a lower durometer than the other of said first and second elastomeric materials;

(e) said second roller being adapted to contact an inking roller of said printing press such that rotation of said second roller is derived from rotation of said inking roller, said inking roller being located in said printing press, said first roller being rotated by said second roller;

(f) pressure setting means for adjustably setting pressure between said first and second rollers.

9. The dampening system of claim 8 further comprising friction means for providing friction to the rotation of said first and second rollers.

10. The dampening system of claim 9 wherein said friction means comprises bushing which rotatably couple said first and second rollers to said support means.

11. A lithographic printing press, comprising:

(a) a printing section having a set of inking rollers for applying ink to a printing plate on a plate cylinder, said printing plate and said plate cylinder being located in said printing press;

(b) an automatic dampening system for applying a fountain solution to said printing plate by way of said inking rollers, said dampening system comprising first and second rollers, reservoir means, and pressure setting means;

(c) said reservoir means for holding a fountain solution which is to be applied to said printing press, said reservoir means being mounted to a supporting means;

(d) said first roller being rotatably mounted to said support means, said first roller having an outer surface, said first roller being positioned relative to said reservoir means so that said first roller outer surface is partially immersed in said fountain solution;

(e) said second roller being rotatably mounted to said support means, said second roller having an outer surface, said second roller being positioned relative to said first roller such that the outer surfaces of said first and second rollers contact at a mixing nip;

(f) said outer surfaces of said first and second rollers being made of an elastomeric material, said elastomeric materials having a relatively soft durometer such that pressure indents are formed in said outer surfaces of said first and second rollers at said mixing nip;

(g) said second roller outer surface being adapted to be rotatably coupled to an outer surface of an inking roller such that rotation of said inking roller rotates said second and first rollers, said inking roller being located in said press, said outer surface durometer of said second roller allowing said second roller to be driven by said inking roller;

(h) pressure setting means for adjusting pressure between said first and second rollers at said mixing nip, said pressure setting means being coupled to at least one of said first and second rollers and causing said one roller to move with respect to the other of said first and second rollers, wherein when the pressure between said first and second rollers is increased said pressure indents at said mixing nip are enlarged.

12. An automatic dampening system for a lithographic printing press, comprising:

a) reservoir means for holding a fountain solution which is to be applied to said printing press, said reservoir means being mounted to a support means;

b) a first roller rotatably mounted to said support means, said first roller having an outer surface, said first roller being positioned relative to said reservoir means so that said first roller outer surface is partially immersed in said fountain solution;

c) a second roller rotatably mounted to said support means, said second roller having an outer surface, said second roller being positioned relative to said first roller such that the outer surfaces of said first and second rollers contact at a mixing nip;

d) said outer surfaces of said first and second rollers being made of a relatively soft material, said outer surfaces of said first and second rollers having a durometer of 20–35;

e) said second roller outer surface being adapted to be rotatably coupled to an outer surface of an inking roller such that rotation of said inking roller rotates said second and first rollers, said inking roller being located in said press;

(f) pressure setting means for adjusting the pressure between said first and second rollers at said mixing nip, said pressure setting means coupled to at least one of said first and second rollers and causing said one roller to move with respect to the other roller of said first and second rollers, wherein when the pressure between the first and second rollers is increased said pressure indents at said mixing nip are enlarged.

13. The dampening system of claim 12 further comprising a bridge roller located between said second roller and said inking roller, said bridge roller bridging a gap between said second roller and said inking roller so as to maintain the rotative coupling between said second roller and said inking roller.

14. The dampening system of claim 12 wherein said pressure setting means comprises:

(a) an adjusting screw located at each end of said other roller, said adjusting screws being threaded and being received by respective threaded bores in said support means, with the ends of said adjusting screws being coupled with the ends of said other roller;

(b) said ends of said other roller being movable in guideways and said support means;

(c) spring means for forcing said ends of said other roller into coupling engagement with said adjusting screw ends.

15. The dampening system of claim 12 further comprising brake means for providing resistance to the rotation of said second roller such that said second roller rotates at a slower surface speed than said inking roller.

16. The dampening system of claim 12, further comprising:

(a) a bridge roller located between said second roller and said inking roller, said bridge roller bridging a gap between said second roller and said inking roller so as to maintain the rotative coupling between said second roller and said inking roller;

(b) said pressure setting means comprising:

(i) an adjusting screw located at each end of said other roller, said adjusting screws being threaded and being received by respective threaded bores in said support means, with the ends of said adjusting screws being coupled with the ends of said other roller;

(ii) said ends of said other roller being movable in guideways and said support means;

(iii) spring means for forcing said ends of said other roller into coupling engagement with said adjusting screw ends;

(c) brake means for providing resistance to the rotation of said second roller such that said second roller rotates at a slower surface speed than said inking roller, said brake means comprising bushings which rotatably couple said second roller to said support means and also comprising the adjustable pressure exerted on said second roller by said first roller with said pressure setting means.

17. An automatic dampening system for a lithographic printing press, comprising:

(a) reservoir means for holding a fountain solution which is to be applied to said printing press, said reservoir means being mounted to a support means;

(b) a first roller rotatably mounted to said support means, said first roller having an outer surface, said first roller being positioned relative to said reservoir means so that said first roller outer surface is partially immersed in said fountain solution;

(c) a second roller rotatably mounted to said support means, said second roller having an outer surface, said second roller being positioned relative to said first roller such that the outer surfaces of said first and second rollers contact at a mixing nip;

(d) said outer surfaces of said first and second rollers being made of a relatively soft material, one of said first and second roller outer surfaces having a durometer of 20–35, the other of said first and second roller outer surfaces having a durometer of 40–55;

(e) said second roller outer surface being adapted to be rotatably coupled to an outer surface of said inking roller such that rotation of said inking roller rotates said second and first rollers, said inking roller being located in said press;

(f) pressure setting means for adjusting the pressure between said first and second rollers at said mixing nip, said pressure setting means coupled to at least one of said first and second rollers and causing said one roller to move with respect to the other roller of said first and second rollers, wherein when the pressure between the first and second rollers is increased said pressure indents at said mixing nip are enlarged.

18. The dampening system of claim 17 further comprising a bridge roller located between said second roller and said inking roller, said bridge roller bridging a gap between said second roller and said inking roller so as to maintain the rotative coupling between said second roller and said inking roller.

19. The dampening system of claim 17 wherein said pressure setting means comprises:

(a) an adjusting screw located at each end of said other roller, said adjusting screws being threaded and being received by respective threaded bores in said support means, with the ends of said adjusting screws being coupled with the ends of said other roller;

(b) said ends of said other roller being movable in guideways and said support means;

(c) spring means for forcing said ends of said other roller into coupling engagement with said adjusting screw ends.

20. The dampening system of claim 17 further comprising brake means for providing resistance to the rotation of said second roller such that said second roller rotates at a slower surface speed than said inking roller.

21. The dampening system of claim 17, further comprising:

(a) a bridge roller located between said second roller and said inking roller, said bridge roller bridging a gap between said second roller and said inking roller so as to maintain the rotative coupling between said second roller and said inking roller;

(b) said pressure setting means comprising:

(i) an adjusting screw located at each end of said other roller, said adjusting screws being threaded and being received by respective threaded bores in said support means, with the ends of said adjusting screws being coupled with the ends of said other roller;

(ii) said ends of said other roller being movable in guideways and said support means;

(iii) spring means for forcing said ends of said other roller into coupling engagement with said adjusting screw ends;

(c) brake means for providing resistance to the rotation of said second roller such that said second roller rotates at a slower surface speed than said inking roller, said brake means comprising bushings which rotatably couple said second roller to said support means and also comprising the adjustable pressure exerted on said second roller by said first roller with said pressure setting means.

* * * * *